US006064020A

United States Patent [19]

Yamada et al.

[11] Patent Number: 6,064,020

[45] Date of Patent: May 16, 2000

[54] KEY SWITCH STRUCTURE

[75] Inventors: Shigeru Yamada; Toshimi Chiba, both of Tokyo, Japan

[73] Assignee: Oki Electric Industry Co., Ltd., Tokyo, Japan

[21] Appl. No.: 09/317,969

[22] Filed: May 25, 1999

[30] Foreign Application Priority Data

May 25, 1998 [JP] Japan ..... 10-142625

[51] Int. Cl.[7] ..... H01H 3/12; H01H 13/70

[52] U.S. Cl. ..... 200/344

[58] Field of Search ..... 200/5 A, 512, 200/517, 344, 345; 400/490, 491, 491.2, 495, 495.1

[56] References Cited

U.S. PATENT DOCUMENTS

| | | | |
|---|---|---|---|
| 5,463,195 | 10/1995 | Watanabe et al. | 200/5 A |
| 5,555,971 | 9/1996 | Takada | 200/345 |
| 5,758,763 | 6/1998 | Sanda et al. | 200/344 |
| 5,767,468 | 6/1998 | Tsai | 200/344 |
| 5,770,824 | 6/1998 | Tsai et al. | 200/5 A |
| 5,829,579 | 11/1998 | Tsai | 200/344 |
| 5,878,872 | 3/1999 | Tsai | 200/344 |

*Primary Examiner*—Michael Friedhofer
*Attorney, Agent, or Firm*—Wenderoth, Lind & Ponack, L.L.P.

[57] ABSTRACT

A key switch comprises a first link member 12 and a second link member 13, and the first link member 12 has a pair of legs 12*a*, 12*b*, linked with each other by a first connection bar 12*c* as well as a second connection bar 12*d*. The legs 12*a*, 12*b* are provided with pivots 12*e*, 12*f*, respectively, and the second link member 13 is attached to the external side of the first link member 12, rotatably about the pivots 12*e*, 12*f*, respectively. The back surface of a key top 11 is provided with a pair of rotation supports 11*a*, 11*b*, and a pair of slide supports 11*c*, 11*d*. The former serving for rotatably supporting one end of the first link member 12, and the latter for slidably supporting one end of the second link member 13. An elastic member 14 is disposed inside the first link member 12, and causes electrical connection to be made between contacts 16*a*, and 16*b* when the key top 11 is pressed down. When the key top 11 is pressed down to a lowermost depth, the first link member 12 and the second link member 13 are moved towards the direction orthogonal to the direction in which the key top 11 is pressed down, superposing on each other entirely. This enables the key top 11 to be set so as to have a low profile.

20 Claims, 10 Drawing Sheets

KEY SWITCH STRUCTURE

BACKGROUND OF THE INVENTION

1. Field of the Invention

The invention relates to a structure of a key switch for use in an input device of an information processing system, and more particularly, to a key switch of a low-profile structure.

2. Description of the Related Art

A conventional key switch has a structure wherein an elastic member with a cup-like shape is disposed above a membrane contact sheet. The membrane contact sheet has a pair of contacts placed opposite to each other and movable so as to come into contact with each other, and the elastic member can be pressed down from above with a key top. A stem extending downward is formed at the center on the underside of the key top so that, when the key top is pressed down, the stem causes the elastic member to undergo deformation downward. The membrane contact sheet is pressed down by the elastic member, and this brings the contacts placed opposite to each other into contact with each other. The stem is guided by a housing so as to be movable up and down, and enabling the key top to perpendicularly move straight up and down.

For effecting satisfactory vertical movement, a guide length, along which the stem is guided by the housing, needs to be set at not less than a given length. Also, for allowing the key top to move up and down perpendicularly even when an edge of the key top is pressed, the guide length along which the stem is guided by the housing needs to be set at not less than the given length. When the guide length is set at not less than the given length, however, the position of the key top tends to become higher. This makes such a key switch unsuitable for use in a portable personal computer and a word processor, of which there is strong demand for a lower profile type.

SUMMARY OF THE INVENTION

It is therefore an object of the invention to provide a key switch having a structure wherein a key top can be moved stably up and down perpendicularly, and maintain the key top at a low level. Another object of the invention is to provide a key switch having a structure wherein a key top can be moved stably up and down perpendicularly even when an edge of the key top is pressed down, and still maintain the key top at a low level. Still another object of the invention is to provide a key switch having a structure wherein the key switch can be assembled with ease while setting a key top at a low level.

To this end, a key switch according to the invention comprises a contact part that is closed when pressed down; a housing disposed above the contact part; an elastic member disposed above the contact part for closing the contact part when pressed down, returning to its initial condition when a pressed-down condition is released; a key top disposed above the elastic member; a first link member having a first engaging part rotatably engaged with the key top, a second engaging part slidably engaged with the housing, and a rotation fulcrum disposed at a center between the first engaging part and the second engaging part; and a second link member having a third engaging part slidably engaged with the key top, and a fourth engaging part rotatably engaged with the housing, and rotatably engaged with the rotation fulcrum of the first link member, at the center between the third engaging part and the fourth engaging part, wherein the first link member and the second link member are superposed (nested) on each other in one plane when the key top is pressed down. Either the first link member or the second link member may be disposed inside the other, and the elastic member may be disposed inside both the first link member and the second link member. Further, both the first link member and the second link member may be formed in a frame-like shape.

The first link member and the second link member may be engaged with each other, rotatably against each other, and formed in a shape symmetric about a fulcrum of such rotation, with respect to a point, so that the key switch can be assembled with ease. Further, the back surface of the key top is provided with supports for slidably supporting the third engaging part of the second link member along the back surface of the key top. The supports are provided with a groove, respectively, for allowing protuberances formed on the third engaging part to be fitted thereinto, and with a wall notched aslant on the edge thereof, respectively, against which the protuberances are butted when fitted into the grooves. This enables the protuberances formed on the third engaging part of the second link member to be fitted into the grooves with ease when assembling the key switch. By beveling the notched edges of the walls, the protuberances can be fitted into the grooves with greater ease. Further, the back surface of the key top may be provided with a stopper, against which a part of the second link member is butted when the key top ascends, so that force required for disengaging the key top from the first link member or the second link member can be set at a desired strength by forming the stopper so as to have a given height. Also, a height of the key top may be set at a desired level by disposing the stopper at a given position

DETAILED DESCRIPTION OF THE PREFERRED EMBODIMENTS

Embodiments of a key switch according to the invention are described hereinafter with reference to the accompanying drawings, and starting from a first embodiment.

Figure 1:
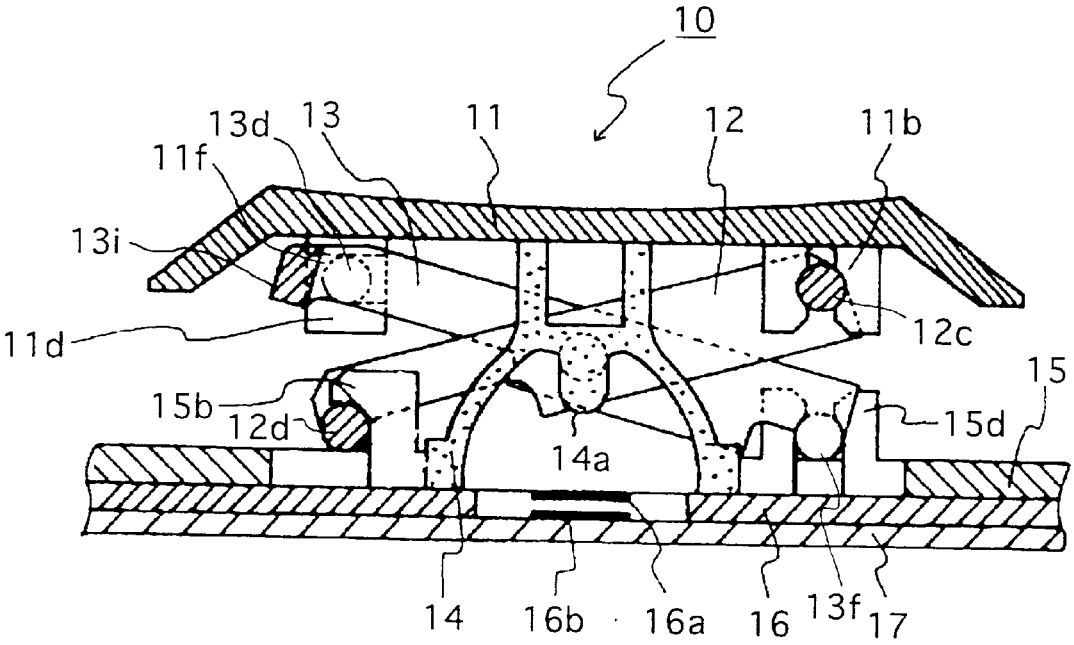
FIG. 1 is a sectional view showing a first embodiment of a key switch according to the invention.
Figure 2:
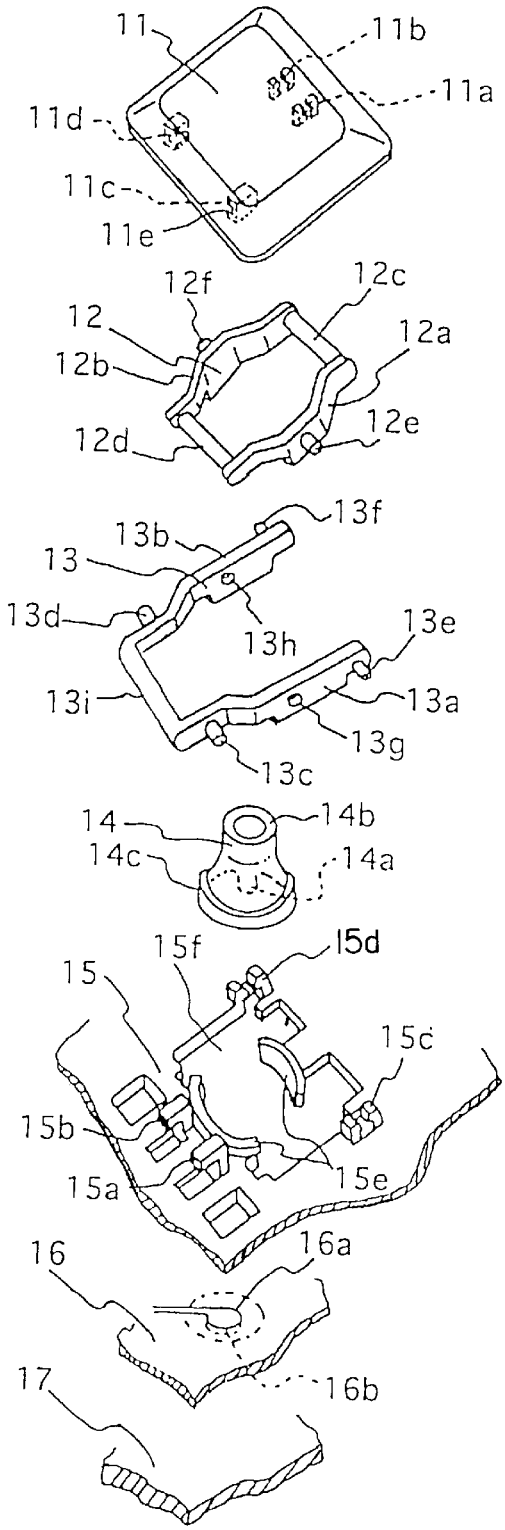
FIG. 2 is a fragmentary exploded view showing the first embodiment of the key switch according to the invention.

In FIGS. 1 and 2, a key switch 10 according to the first embodiment has a basic construction made up of a key top 11, a first link member 12, a second link member 13, an elastic member 14, a housing 15, a membrane contact sheet 16, and a base plate 17. The back surface of the key top 11 is provided with a pair of rotation supports 11*a*, 11*b*, for rotatably supporting one end of the first link member 12, and with a pair of slide supports 11*c*, 11*d* for slidably supporting one end of the second link member 13 in the horizontal direction in FIG. 1. As shown in FIG. 1, grooves 11*e*, 11*f* are formed in the slide supports 11*c*, 11*d*, respectively, allowing the one end of the second link member 13 to fit slidably therein.

The first link member 12 has a pair of legs 12*a*, 12*b*, one ends of which are attached, respectively, to a first connection bar 12*c* so as to link the legs 12*a*, 12*b* together. The other ends of the legs 12*a*, 12*b*, respectively, are attached to a second connection bar 12*d* so as to link also the legs 12*a*, 12*b* together. Both the first connection bar 12*c* and the second connection bar 12*d* have a columnar shape. The first connection bar 12*c* is mounted rotatably in the rotation supports 11*a*, 11*b* of the key top 11 when the key switch 10 is assembled.

Figure 3:
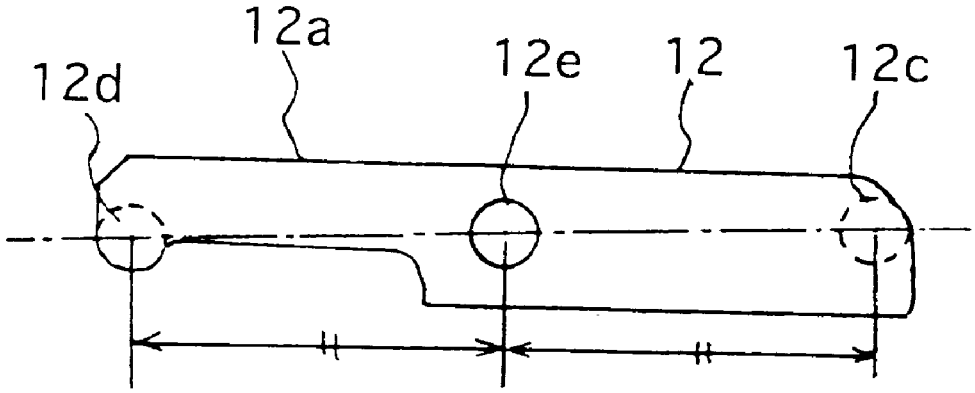
FIG. 3 is a side view showing a link member of the first embodiment of the key switch according to the invention.

The legs 12*a*, 12*b* are provided with pivots 12*e*, 12*f*, respectively, at a position in line with a straight line connecting the first connection bar 12*c* with the second connection bar 12*d* in a side view, and equidistant from the first connection bar 12*c* and the second connection bar 12*d*, respectively. As shown in FIG. 3, the first connection bar 12*c*, the pivot 12*e*, and the second connection bar 12*d* are arranged in a line, and a distance from the first connection bar 12*c* to the pivot 12*e* is equal to a distance from the second connection bar 12*d* to the pivot 12*e*.

The second link member 13 has a pair of legs 13*a*, 13*b*. The legs 13*a*, 13*b* are provided with first support protuberances 13*c*, 13*d*, protruding outwards, at one end thereof, respectively, and with second support protuberances 13*e*, 13*f*, protruding outwards, at the other end thereof, respectively. The legs 13*a*, 13*b* are linked with each other at one end thereof by a connection part 13*i*. The first support protuberances 13*c*, 13*d* are fitted slidably into the grooves 11*e*, 11*f* formed in the slide supports 11*c*, 11*d* of the key top 11, respectively, when the key switch is assembled. A distance from the first support protuberances 13*c*, 13*d* to the second support protuberances 13*e*, 13*f*, respectively, is set at the same distance as that from the first connection bar 12*c* to the second connection bar 12*d* of the first link member 12. Further, a rotation hole 13*g* is provided in the side of the leg 13*a*, at a position in line with a straight line connecting the first support protuberance 13*c* with the second support protuberance 13*e*, and equidistant from the first support protuberance 13*c* and the second support protuberance 13*e*, respectively, as seen in a side view. Similarly, a rotation hole 13*h* is provided in the side of the leg 13*b*, at a position in line with a straight line connecting the first support protuberance 13*d* with the second support protuberance 13*f*, and equidistant from the first support protuberance 13*d* and the second support protuberance 13*f*, respectively, as seen in a side view.

Figure 4:
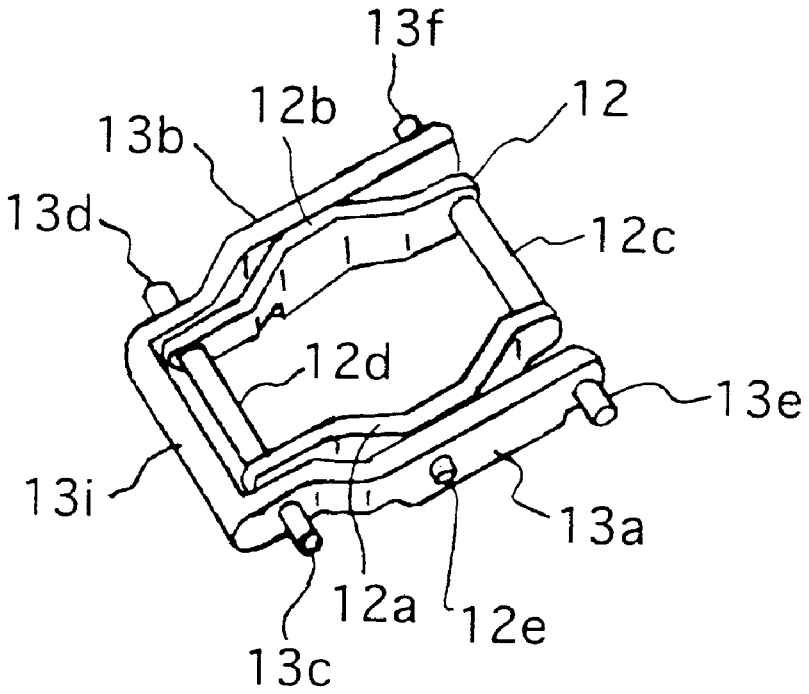
FIG. 4 is a perspective view showing a first link member and a second link member of the first embodiment of the key switch according to the invention.

The first link member 12 and the second link member 13 can be assembled together rotatably against each other by fitting the pivots 12*e*, 12*f* of the first link member 12 into the rotation holes 13*g*, 13*h* of the second link member 13, respectively. When assembled this way, the pivots 12*e*, 12*f* of the first link member 12 are fitted into the rotation holes 13*g*, 13*h* of the second link member 13, respectively, from inside of the legs 13*a*, and 13*b*. As shown in FIG. 4, the first link member 12 in whole is ensconced in a space surrounded by the legs 13*a*, 13*b*, and the connection part 13*i* of the second link member 13, so that the first link member 12 and the second link member 13 are contained in one plane. Further, at this point in time, the first connection bar 12*c* of the first link member 12 is in line with the second protuberances 13*e*, 13*f* of the second link member 13, and the second connection bar 12*d* of the first link member 12 is in line with the first protuberances 13*c*, 13*d* of the second link member 13.

The elastic member 14 is disposed between the key top 11 and the membrane contact sheet 16 in a vertical direction, and inside the first link member 12 in a horizontal direction. The elastic member 14 is composed of rubber or the like, and formed substantially in the shape of a cone, having a contact press-down part 14*a* protruding downwards in a space within. An upper part 14*b* of the elastic member 14 is kept in contact with the back surface of the key top 11, and when the upper part 14*b* is pressed down by the key top 11, the elastic member 14 is caused to undergo deformation downwards, causing the contact press-down part 14*a* to press the membrane contact sheet 16 down.

The housing 15 is provided with slide guides 15*a*, 15*b* and rotation guides 15*c*, 15*d*, respectively. The second connection bar 12*d* of the first link member 12 is slidably engaged with the slide guides 15*a*, 15*b*. The second support protuberances 13*e*, 13*f* of the second link member 13 are rotatably engaged with the rotation guides 15*c*, 15*d*, respectively. Further, the housing 15 is provided with a fixture opening 15*f*, and also with guide walls 15*e* which are formed so as to face the fixture opening 15*f*. The elastic member 14 is disposed through the fixture opening 15*f* surrounded by the guide walls 15*e*, which serve to securely hold a position of a lower edge 14*c* of the elastic member 14 so as not to allow the lower edge 14*c* to spread sideways when the elastic member 14 is pressed down.

The membrane contact sheet 16 has a movable contact 16*a* and a fixed contact 16*b* disposed opposite to the movable contact 16*a* with a predetermined spacing therebetween. Electrical connection is made by contacting the movable contact 16*a* with the fixed contact 16*b*, which turns the key switch into a closed state. The base plate 17 is disposed at the bottom of the various components described in the foregoing, and securely attached to the housing 15 by screws and so forth.

Now the switching operation of the first embodiment is described hereinafter with reference to FIG. 5. The key switch 10 is in a condition shown in FIG. 1 before the key top 11 is pressed down- When the key top 11 in the condition described is pressed down, and moved downwards, the first link member 12 rotates clockwise, as seen in FIG. 1, about the first connection bar 12*c* supported by the rotation supports 11*a*, 11*b* of the key top 11. The second connection bar 12*d* of the first link member 12 is slid in the horizontal direction (to the left side) as seen FIG. 1, and is guided by the slide guides 15*a*, 15*b* of the housing 15. Thus, the first link member 12 gradually descends.

Upon the descent of the key top 11, the second link member 13 is rotated counterclockwise about the second support protuberances 13*e*, 13*f* supported by the slide guides 15*a*, 15*b* of the housing 15, following the descending motion of the first link member 12, because the pivots 12*e*, 12*f* of the first link member 12 are fitted in the rotation holes 13*g*, 13*h* of the second link member 13. The first support protuberances 13*c*, 13*d* of the second link member 13 are slid in the horizontal direction (to the left) as seen in FIG. 1, and are guided by the slide supports 11*c*, 11*d* of the key top 11. That is, the second link member 13 as well gradually descends, concurrently with the descent of the first link member 12.

As a result, the key top 11 is moved downwards while maintaining a posture parallel with the housing 15. Following the downward movement of the key top 11, the back surface thereof presses the upper part 14*b* of the elastic member 14 down, and the elastic member 14 is subjected to compressive deformation, and thereby causing the contact press-down part 14*a*, which protrudes downwards, to butt against the membrane contact sheet 16, and to press the same down. This will bring the movable contact 16*a* into contact with the fixed contact 16*b*, effecting electrical connection, so that the key switch is turned into a closed state.

Figure 5:
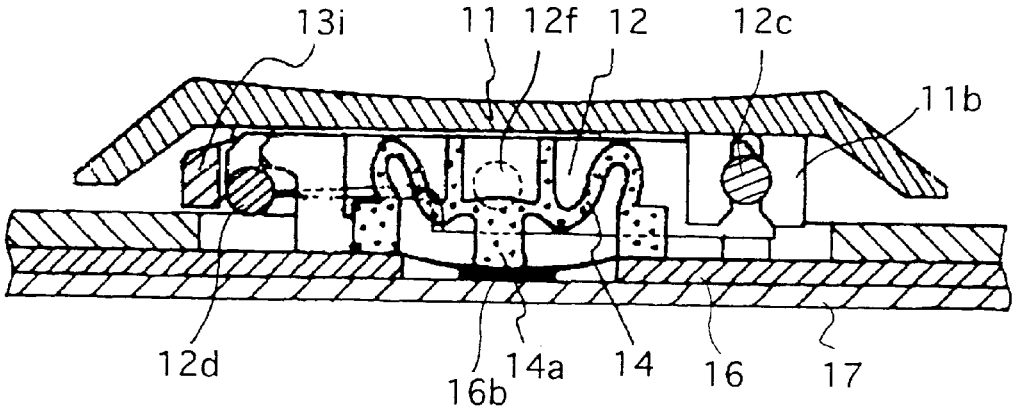
FIG. 5 is a sectional view showing the first embodiment of the key switch when a key top is pressed down.

When the key top 11 is further pressed down, both the first link member 12 and the second link member 13 are rotated until both assume a position parallel with the housing 15 as shown in FIG. 5. The first link member 12 and the second link member 13 are not superposed on each other vertically, because the first link member 12 is disposed inside the second link member 13.

At this stage of operation, the elastic member 14 is compressed to an extent of a thickness of the first link member 12 as well as the second link member 13, so that a distance from the back surface of the key top 11 to the surface of the housing 15 is substantially equivalent to the thickness of the first link member 12 as well as the second link member 13.

Upon the release of pressing the key top 11 down, the first link member 12, the second link member 13, and the key top 11 are restored to the initial positions thereof as shown in FIG. 1 due to resilience of the elastic member 14. The movable contact 16*a* of the membrane contact sheet 16 is disconnected from the fixed contact 6, and the key switch is returned to an open state.

As described above, according to the first embodiment, the key switch is constructed such that the first link member 12 is ensconced in the second link member 13. Both the link members 12, 13 are disposed so as not to be superposed on each other vertically (in the direction in which the key switch is pressed down), and the elastic member 14 is disposed inside the first link member 12 so as to come into direct contact with the key top 11. Accordingly, the key switch 10 with the key top 11 having a low profile can be fabricated while maintaining a sufficiently long stroke to pushing of the key switch.

Figure 6:
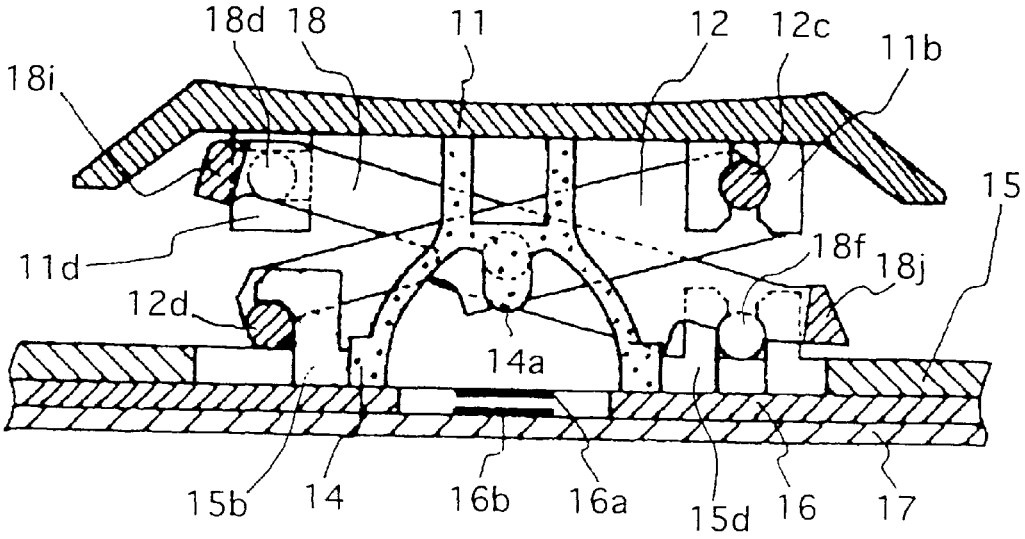
FIG. 6 is a sectional view showing a second embodiment of a key switch according to the invention.
Figure 7:
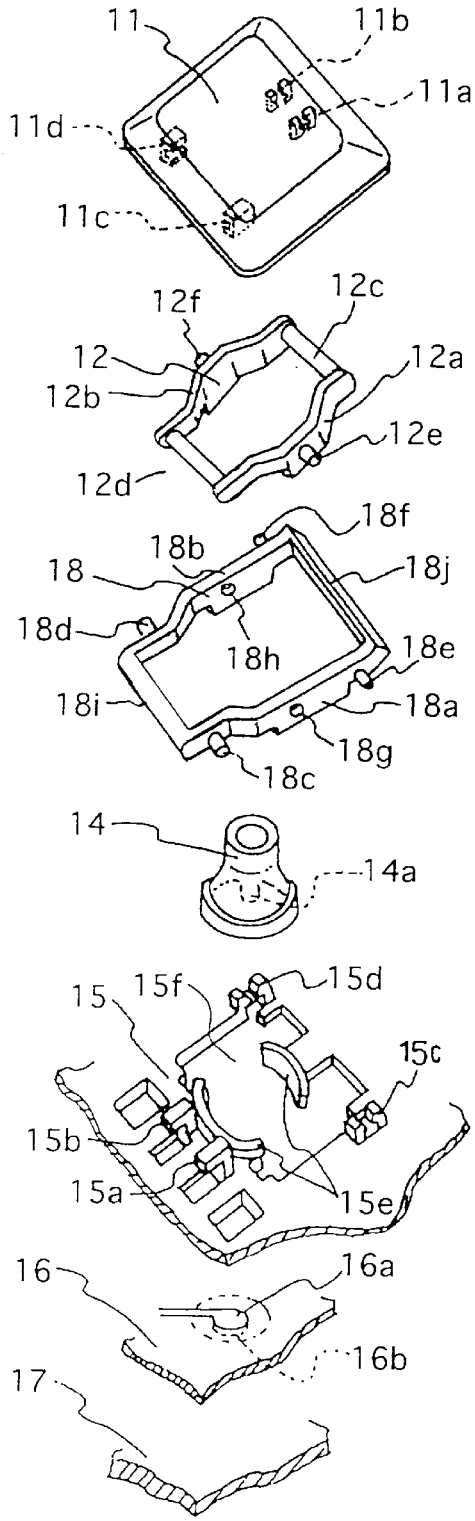
FIG. 7 is a fragmentary exploded view showing the second embodiment.
Figure 8:
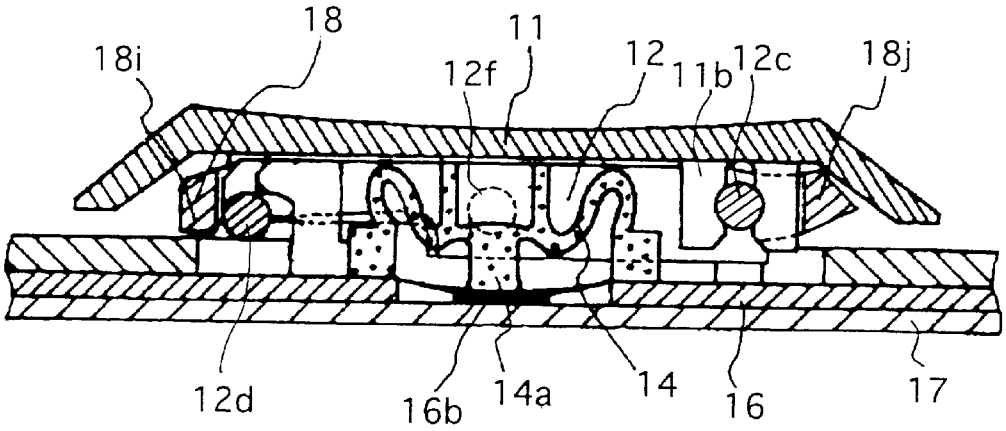
FIG. 8 is a sectional view showing the second embodiment of the key switch when a key top is pressed down.

Next, a second embodiment of the invention is described hereinafter. In FIGS. 6 and 7, with a key switch according to the second embodiment, a second link member 18 has a pair of legs 18*a*, 18*b*. The legs 18*a*, 18*b* are provided with first support protuberances 18*c*, 18*d*, protruding outwards, at one end of the second link member 18, respectively, and with second support protuberances 18*e*, 18*f*, protruding outwards, at the other end thereof, respectively. The legs 18*a*, 18*b* are linked with each other at one end of the second link member 18 by a connection part 18*i* and at the other end by a connection part 18*j*. The first support protuberances 18*c*, 18*d* are fitted slidably into grooves 11*e*, 11*f* formed in slide supports 11*c*, 11*d* of the key top 11, respectively, when the key switch is assembled. The key switch is in a shape in section such that the connection parts 18*i*, and 18*j* are positioned so as not to interfere with other members thereof in a space between the key top 11 and the housing 15 as shown in FIG. 8 when the key top 11 is pressed down.

A distance from the first support protuberances 18*c* , 18*d* to the second support protuberances 18*e*, 18*f*, respectively, is set to be equivalent to the distance from the first connection bar 12*c* to the second connection bar 12*d* of the first link member 12. Further, a rotation hole 18*g* is provided in the side of the leg 18*a*, at a position in line with a straight line connecting the first support protuberance 18*c* with the second support protuberance 18*e*, and equidistant from the first support protuberance 18*c* and the second support protuberance 18*e*, respectively, as seen in a side view. Likewise, a rotation hole 18*h* is provided in the side of the leg 18*b*, at a position in line with a straight line connecting the first support protuberance 18*d* with the second support protuberance 18*f*, and equidistant from the first support protuberance 18*d* and the second support protuberance 18*f*, respectively, as seen in a side view. This embodiment has the same construction as that for the first embodiment in other respects.

In the key switch according to the second embodiment, the rigidity of the second link member 18 is enhanced by providing opposite ends thereof with the connection parts 18*i*, 18*j*, respectively, acting as members for linking the pair of the legs 18*a*, 18*b* with each other. For enhancing the rigidity of the link members simply, a through-axle may be installed between pivots 12*e* and 12*f* of the first link member 12 as well as between the rotation holes 18*g* and 18*h* of the second link member 18 in such a way as to penetrate through the center of a space defined by the first link member 12 as well as the second link member 18. In this case, however, the through-axle will interfere with disposition of the elastic member 14, and consequently, it is impossible to fabricate a key switch of a low profile structure. Accordingly, in the second embodiment, a space in the middle of the first link member 12 is kept open. The second link member 18 is formed in a shape so as to surround the four sides of the first link member 12, thereby securing a space for disposition of the elastic member 14 while providing rigidity. Thus, with the key switch according to the second embodiment, not only a low profile structure is implemented but also the rigidity of the second link member 18 is enhanced. It is possible to minimize inclination of the key top 11 due to deformation of the second link member 18 even in the case of one edge of the key top 11 being pressed. Steady switching operation is ensured whichever part of the key top 11 is pressed.

Figure 9:
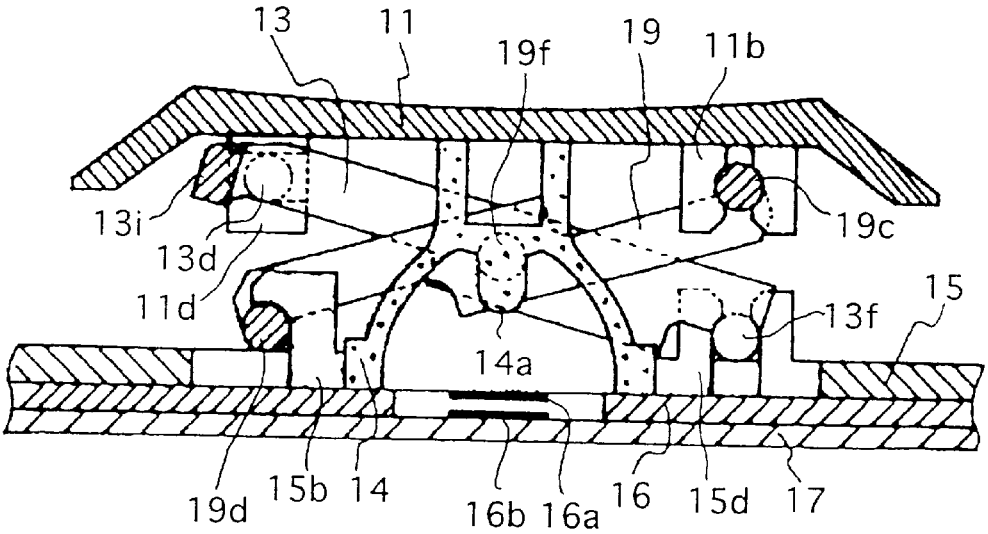
FIG. 9 is a sectional view showing a third embodiment of a key switch according to the invention.
Figure 10:
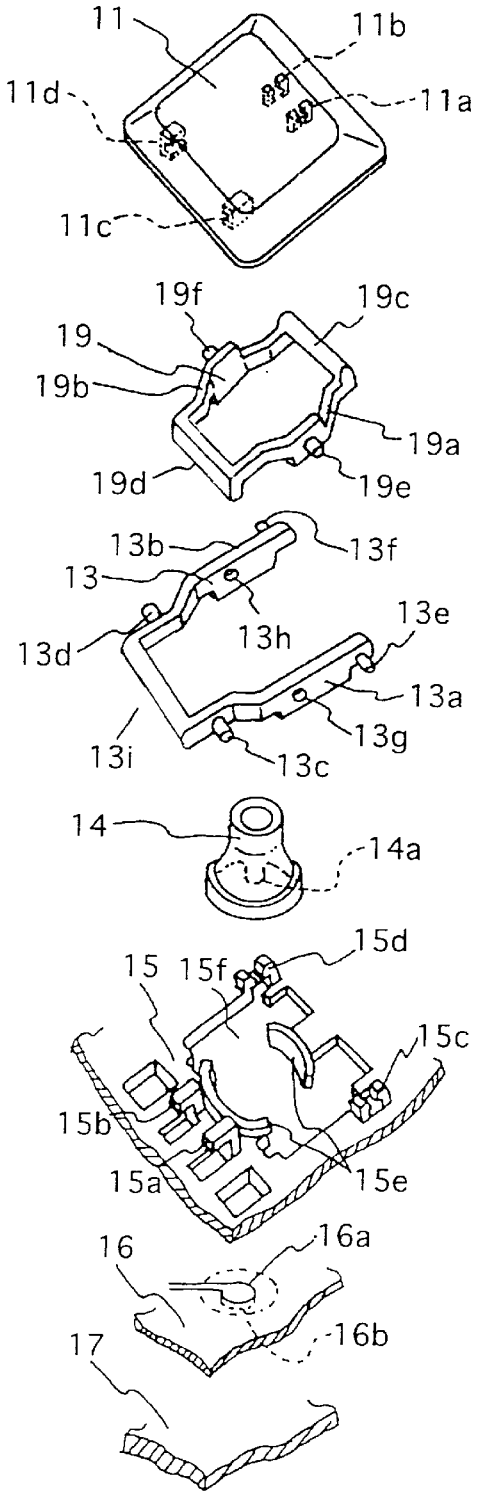
FIG. 10 is a fragmentary exploded view showing the third embodiment.

Next, a third embodiment of the invention is described hereinafter. In FIGS. 9 and 10, show a key switch according to the third embodiment. A first link member 19 has a pair of legs 19*a*, 19*b*, one end of each is attached, respectively, to a first connection bar 19*c* so as to link the legs 19*a*, 19*b* together. The other ends of the legs 19*a*, 19*b* are attached, respectively, to a second connection bar 19*d* so as to link the legs 19*a*, 19*b* together. Both the first connection bar 19*c* and the second connection bar 19*d* are columnar in shape. The first connection bar 19*c* is mounted rotatably in rotation supports 11*a*, 11*b* of the key top 11 when the key switch is assembled. In a side view, the legs 19*a*, 19*b* are provided with pivots 19*e*, 19*f*, respectively, at a position in line with a straight line connecting the first connection bar 19*c* with the second connection bar 19*d*, and equidistant from the first connection bar 19*c* and the second connection bar 19*d*, respectively. As in the case of the first embodiment, the first connection bar 19*c*, the pivot 19*e*, and the second connection bar 19*d* are arranged in a line. In other respects, this embodiment has the same construction as that for the first embodiment.

Further, the first link member 19 is in a shape symmetric about the pivots 19*e*, 19*f*, respectively. More specifically, the first link member 19 is formed such that when the first link member 19 is rotated by 180° about a straight line connecting the pivot 19*e* with the pivot 19*f*, it will be in the same shape as before. Accordingly, when assembling the key switch, assembling operation can be performed without caring about orientation of the first link member formed in such a shape, thereby improving efficiency of the assembling operation.

Figure 11:
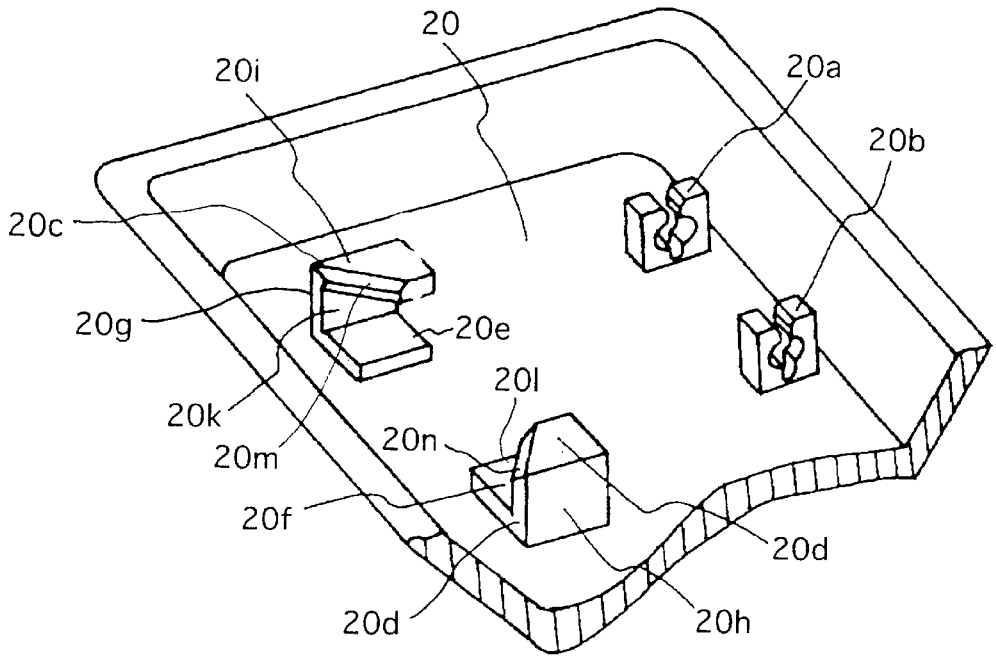
FIG. 11 is a schematic illustration showing a key top of a fourth embodiment of a key switch according to the invention.

Next, a fourth embodiment of the invention is described hereinafter. In FIG. 11, with a key switch according to the fourth embodiment, the back surface of a key top 20 is provided with a pair of rotation supports 20*a*, 20*b*, and a pair of slide supports 20*c*, 20*d*. FIG. 11 shows the back surface of the key top 20. The rotation supports 20*a*, 20*b* are for rotatably supporting the first connection bar 12*c* (not shown here) of the first link member 12, and the slide supports 20*c*, 20*d* are for slidably supporting the first support protuberances 13*c*, 13*d* (not shown here) of the second link member 13.

The slide supports 20*c*, 20*d* are formed in a shape substantially resembling the letter U, respectively, and provided with fixed walls 20*e*, 20*f*, side walls 20*g*, 20*h*, and opposite walls 20*i*, 20*j*, respectively. Grooves 20*k*, 20*l* are formed in an area surrounded by the aforesaid walls. The opposite walls 20*i*, 20*j* are notched aslant at sides, opposite from the rotation supports 20*a*, 20*b*, respectively, such that a width thereof gradually decreases towards the inner side of the key top, and notched edges 20*m*, 20*n* are beveled. In other respects, this embodiment has the same construction as that for the first embodiment.

Figure 12:
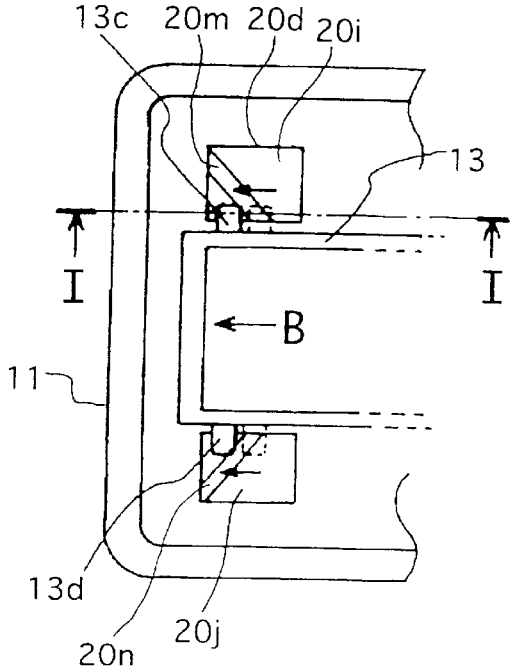
FIG. 12 is a schematic illustration showing an assembling procedure of the key switch according to the fourth embodiment.
Figure 13:
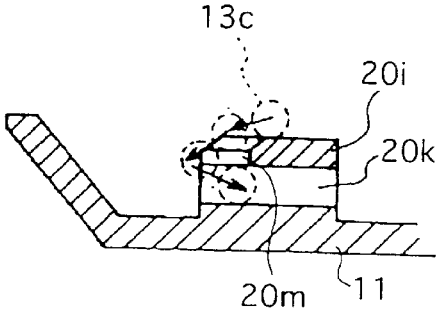
FIG. 13 is a sectional view taken on line I—I of FIG. 12.

Now a procedure for assembling the key top according the fourth embodiment is described hereinafter with reference to FIGS. 2, 12, and 13. In FIGS. 2, and 12, the base plate 17, the membrane contact sheet 16, and the housing 15 are first securely held together by screws and the like (1). Subsequently, the elastic member 14 is disposed at a proper position to match the guide walls 15*e* of the housing 15 (2). Then, by fitting the pivots 12*e*, 12*f* of the first link member 12 into the rotation holes 13*g*, 13*h* of the second link member 13, respectively, the first link member 12 is rotatably assembled with the second link member 13 (3). A second connection bar 12*d* of the first link member 12 is inserted into the slide guides 15*a*, 15*b* of the housing 15, and the second support protuberances 13*e*, 13*f* of the second link member 13 are inserted into rotation guides 15*c*, 15*d* of the housing 15 (4). By pressing the key top 20 down from above the first link member 12, the second link member 13, and the elastic member 14, the first connection bar 12*c* of the first link member 12 is fitted into the rotation supports 20*a*, 20*b* of the key top 20, and the first support protuberances 13*c*, 13*d* of the second link member 13 are fitted into the grooves 20*k*, 20*l* of the slide supports 20*c*, 20*d* of the key top 20, respectively, (5).

In the aforesaid step (5) the first support protuberances 13*c*, 13*d* of the second link member 13 are fitted into the grooves 20*k*, 20*l* of the slide supports 20*c*, 20*d* of the key top 20, respectively. A force is at work on the first support protuberances 13*c*, 13*d* to move the same in the direction of the arrow B in FIG. 12 while keeping the same in contact with the opposite walls 20*i*, 20*j* of the slide supports 20*c*, 20*d*, respectively, when the key top 20 is pressed down. This causes legs 13*a*, 13*b* and a connection part 13*i* of the second link member 13 to undergo elastic deformation, allowing the first support protuberances 13*c*, 13*d* to be inserted into the grooves 20*k*, 20*l*. More specifically, as shown in FIG. 13, the first support protuberances 13*c*, 13*d* are first guided to the left side in the figure, moved downward along the notched edges 20*m*, 20*n*, respectively, and pushed into the grooves 20*k*, 20*l*, respectively. Since the notched edges 20*m*, 20*n* are beveled, the first support protuberances 13*c*, 13*d* can be moved smoothly along the notched edges 20*m*, 20*n*, respectively.

As described above, with the key switch according to the fourth embodiment, the second link member 13 can be attached to the key top 20 with ease, because the notched edges 20*m*, 20*n* are formed aslant at the side of the opposite walls 20*i*, 20*j* of the slide supports 20*c*, 20*d* of the key top 20, respectively.

Figure 15:
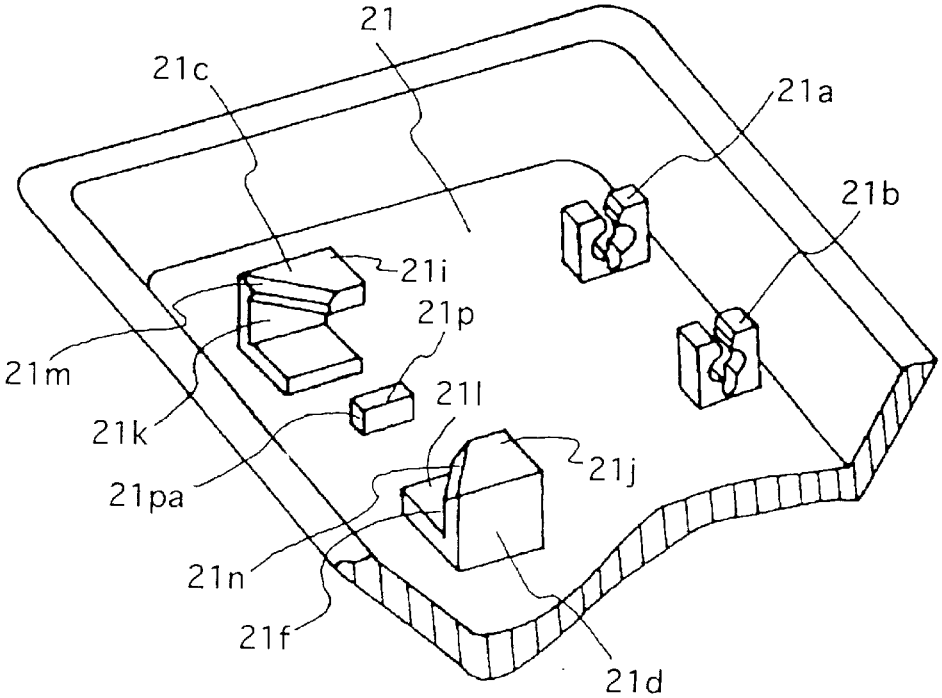
FIG. 15 is a schematic illustration showing a key top of the fifth embodiment of the key switch according to the invention.

Next, a fifth embodiment of the invention is described hereinafter. FIG. 15, shows a key switch according to the fifth embodiment. A key top 21 is provided with a pair of slide supports 21*c*, 21*d*, similar to the slide supports 20*c*, 20*d* of the fourth embodiment. Notched edges 21*m*, 21*n* are formed aslant at sides of opposite walls 21*i*, 21*j* of the slide supports 21*c*, 21*d*, respectively. A stopper 21*p* is formed at a given position between the slide support 21*c*, and the slide support 21*d* to have a given height. The stopper 21*p* is formed at a position opposite to a connection part 13*i* of a second link member 13.

Figure 14:
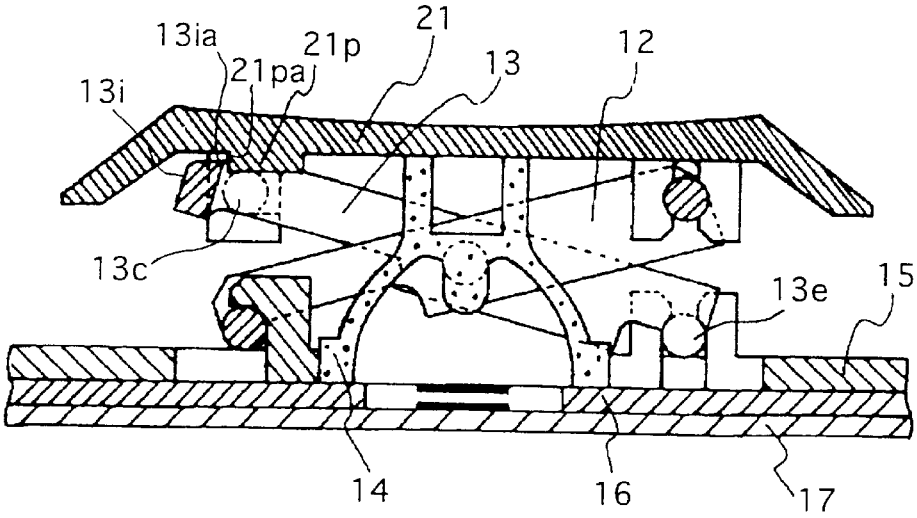
FIG. 14 is a sectional view showing a fifth embodiment of a key switch according to the invention.

As shown in FIG. 14, in a state wherein the key top 21 is not pressed down, an edge 13*ia* of the connection part 13*i* of the second link member 13 is butted against a side edge 21*pa* of the stopper 21*p*. In the case of external force being applied to the key top 21 so as to raise the same, the second link member 13 tends to rotate about second support protuberances 13*e*, 13*f* thereof clockwise in FIG. 14 while the first support protuberances 13*c*, 13*d* tend to move further towards the inner side of the key top 21 in grooves 20*k*, 20*l* of the slide supports 21*c*, 21*d*, respectively. In this embodiment the stopper 21*p* is installed at the given position; however, the edge 13*ia* of the connection part 13*i* of the second link member 13 is butted against the side edge 21*pa* of the stopper 21*p*, preventing movement of the first support protuberances 13*c*, 13*d*. It is desirable that the edge 13*a* of the connection part 13*i* is butted against the side edge 21*pa* at a position where the first support protuberances 13*c*, 13*d* are not disengaged from the grooves 21*k*, 21*l* of the slide supports 21*c*, 21*d*, respectively. By holding back movement of the first support protuberances 13*c*, 13*d*, disengagement of the key top 21 can be prevented.

In the case of a stronger force being applied to the key top 21 so as to raise the same, the connection part 13*i* butted against the side edge 21*pa* of the stopper 21*p* undergoes elastic deformation, and goes over the stopper 21*p*, so that the first support protuberances 13*c*, 13*d* are slipped out of the grooves 21*k*, 21*l* of the slide supports 21*c*, 21*d*, respectively, towards the inner side of the key top 21.

It is possible to estimate magnitude of force for causing the first support protuberances 13*c*, 13*d* to go over the stopper 21*p*, and the key top 21 to be disengaged if the height of the stopper 21*p* is set at a given value. If the stopper 21*p* is formed so as to have a high height, the required force disengaging the key top 21 is set high, and conversely, if the stopper 21*p* is formed so as to have a low height, the required force for disengaging the key top 21 is set low.

As described above, with the fifth embodiment of the invention, the magnitude of the force required for disengagement of the key top 21 can be set to the desired strength by installing the stopper 21*p* on the back surface of the key top 21, and by setting height of the stopper 21*p* to a desired value.

Further, the height of the key top 21 can be set by the position of the stopper 21*p*. In FIG. 14, the key top 21 is urged upward by an elastic member 14, and the height of the key top 21 is restrained by the edge 13*ia* of the connection part 13*i* of the second link member 13 butted against the side edge 21*pa* of the stopper 21*p*. Accordingly, by altering the position of the stopper 21*p* towards the right side or the left side in FIG. 14, the height of the key top 21 can be altered. Thus, the height of the key top 21 can be set with ease by adjusting the position of the stopper 21*p*. It goes without saying that the same effect can be obtained by installing the stopper 21*p* at a position so as to be butted against the first connection bar 12*c* of the first link member 12.

What is claimed is:

1. A key switch comprising:

a contact part which closes when pressed down;

a housing disposed above said contact part;

an elastic member disposed above said contact part for closing said contact part when pressed down and wherein said elastic member returns to an initial condition when released;

a key top disposed above said elastic member, wherein said key top has a back surface;

a first link member having a first engaging part rotatably engaged with said key top, a second engaging part slidably engaged with said housing, and a rotation fulcrum disposed at a center between said first engaging part and said second engaging part;

a second link member having a third engaging part slidably engaged with said key top, and a fourth engaging part rotatably engaged with said housing, wherein said second link is rotatably engaged with said rotation fulcrum of said first link member at a center between said third engaging part and said fourth engaging part;

wherein said first link member and said second link member are nested in each other in one plane when said key top is pressed down;

wherein one of said first link member and said second link member is disposed inside the other, and wherein said elastic member is disposed inside both said first link member and said second link member;

wherein said first link member and said second link member are formed in a frame-like shape; and a stopper provided on said back surface of said key top, wherein a part of said second link member is butted against said stopper when said key top ascends, and wherein said stopper has a height which sets a force required for disengaging said key top from one of said first and second link members to a desired strength.

2. A key switch according to claim 1, wherein said stopper is disposed at a given position in order to set a height of said key top to a desired value.

3. A key switch comprising:

a contact part which closes when pressed down;

a housing disposed above said contact part;

an elastic member disposed above said contact part for closing said contact part when pressed down and wherein said elastic member returns to an initial condition when released;

a key top disposed above said elastic member;

a first link member having a first engaging part rotatably engaged with said key top, a second engaging part slidably engaged with said housing, and a rotation fulcrum disposed at a center between said first engaging part and said second engaging part;

a second link member having a third engaging part slidably engaged with said key top, and a fourth engaging part rotatably engaged with said housing, wherein said second link is rotatably engaged with said rotation fulcrum of said first link member and disposed at a center between said third engaging part and said fourth engaging part;

wherein said first link member and said second link member are nested in each other in one plane when said key top is pressed down; and wherein one of said first link member and second link member is an inside link member and the other is an outside link member, wherein said inside link member is disposed inside said outside link member, and wherein said engaging parts of said inside link member are coplanar with said engaging parts of said outside link member when said key top is pressed down.

4. A key switch according to claim 3, wherein said elastic member is disposed inside both said first link member and said second link member.

5. A key switch according to claim 4, wherein both said first link member and said second link member are formed in a frame-like shape.

6. A key switch according to claim 4, wherein said first link member has a shape that is symmetric about said rotation fulcrum.

7. A key switch according to claim 3, wherein said key top has a back surface and supports provided on said back surface for slidably engaging said third engaging part along said back surface of said key top, wherein said third engaging part has protuberances formed on said third engaging part, wherein said supports include grooves and walls having edges notched aslant, wherein said protuberances are fitted in said grooves, and wherein said protuberances butt said edges when fitted into said grooves.

8. A key switch according to claim 7, wherein said edges of said walls are beveled.

9. A key switch comprising:

a key top;

a housing disposed below said key top;

a first link member having a pair of legs, a first connection bar rotatably engaged with said key top, a second connection bar slidably engaged with said housing, and a pair of pivots, wherein said first connection bar connects together said pair of legs at one end of said first link member and said second connection bar connects together said pair of legs at the other end of said first link member, wherein each of said legs is respectively provided with one of said pivots, wherein said pivots are positioned in a plane that includes said first connection bar and said second connection bar, and wherein said pivots are positioned equidistant from both said first connection bar and said second connection bar;

a second link member pivotally fined around said first link member, wherein said second link member includes a pair of legs, a connection part connecting said pair of legs of said second link member at one end of said second link member, a pair of outwardly protruding first support protuberances slidably engaged with said key top, a pair of outwardly protruding second support protuberances rotatably engaged with said housing, and a pair of rotation holes provided in said legs of said second link member, wherein a distance from said support protuberances to said second support protuberances is equal to a distance from said first connection bar to said second connection bar, wherein said rotation holes are positioned in a plane that includes said first support protuberances and said second support protuberances, wherein said rotation holes are positioned equidistant from said both said first support protuberances and said second support protuberances, and wherein said pivots of said first link member are rotatably fitted to said rotation holes; and wherein said first and second connection bars of said first link member are located between and aligned with respectively said second and first support protuberances of said second link member when said key top is pressed down.

10. A key switch according to claim 9, further comprising a contact provided below said housing.

11. A key switch according to claim 10, further comprising an elastic member provided between said contact part and key top for closing said contact when said key top is pressed down.

12. A key switch according to claim 11, wherein said elastic member includes a lower edge, and wherein said housing includes a guide wall abutting said lower edge of said elastic member.

13. A key switch according to claim 9, wherein said second link member includes a second connection part connecting said pair of legs of said second link member at an end of said second link member opposite from said connection part.

14. A key switch according to claim 9, wherein said first link member is symmetric about said pivots.

15. A key switch according to claim 9, wherein said key top includes a bottom surface and a pair of slide supports provided on said bottom surface, wherein said pair of outwardly protruding first support protuberances of said second link member are slidably engaged with said pair of slide supports.

16. A key switch according to claim 15, wherein said key top includes a rotation support provided on said bottom surface and rotatably engaged with said first connection bar.

17. A key switch according to claim 16, wherein each of said slide supports includes a wall having a notched edge, wherein said notched edge is notched aslant at a side of said wall opposite from said rotation supports, and wherein said notched edge is beveled.

18. A key switch according to claim 17, wherein said key top includes a stopper provided between said slide supports.

19. A key switch according to claim 9, wherein said key top includes a pair of rotation supports rotatably engaged with said first connection bar.

20. A key switch according to claim 9, wherein said housing includes a pair of rotation guides rotatably engaged with said second support protuberances of said second link member, and a pair of slide guides slidably engaged with said second connection bar of said first link member.

* * * * *